United States Patent [19]

Persson

[11] Patent Number: 4,601,071

[45] Date of Patent: Jul. 22, 1986

[54] FLUSH SYSTEM

[76] Inventor: Bengt A. Persson, Corso Italia 28 B, CH-6911 Campione d'Italia, Switzerland

[21] Appl. No.: 740,078

[22] PCT Filed: Sep. 27, 1984

[86] PCT No.: PCT/SE84/00313

§ 371 Date: May 3, 1985

§ 102(e) Date: May 3, 1985

[87] PCT Pub. No.: WO85/01537

PCT Pub. Date: Apr. 11, 1985

[30] Foreign Application Priority Data

Oct. 5, 1983 [SE] Sweden ..... 8305455

[51] Int. Cl.[4] ..... E03D 1/18

[52] U.S. Cl. ..... 4/333; 4/325; 4/395; 137/391; 137/426; 137/410; 137/432; 137/430; 137/397

[58] Field of Search ..... 4/333–339, 4/300, 378, 379, 380, 366, 367, 387, 395, 396, 324, 325, 345; 137/410, 390, 426, 432, 430, 397, 391

[56] References Cited

U.S. PATENT DOCUMENTS

| | | | |
|---|---|---|---|
| 918,216 | 4/1909 | Stickdorn | 4/334 |
| 1,629,421 | 5/1927 | Stickdorn | 4/334 |
| 2,882,533 | 4/1959 | Gray | 4/334 |

*Primary Examiner*—Stephen Marcus
*Assistant Examiner*—Linda J. Sholl
*Attorney, Agent, or Firm*—Kinzer, Plyer, Dorn & McEachran

[57] ABSTRACT

A flushing system for rapidly delivering a given volume of water supplied to an accumulating chamber (5) from an automatically or manually operated valve (6) has a float-controlled discharge valve (19) which is arranged to be opened when said given volume of water has been delivered to the accumulating chamber (5) and the float is located at a corresponding level in said chamber. A supply pipe (13) extends downwardly in the accumulating chamber (5) towards the outlet (3), and a valve housing (19) is slidably arranged, together with the float, on the water supply pipe. In a closing position of the valve housing, the lower edge part of the valve encircles the outlet. In an opening position of the valve housing, with water in the accumulating chamber, the valve housing is lifted from the seating. The lower end of the supply pipe is formed with a valve body (17) arranged, together with the valve housing, to form a pressure chamber (24) having a leakage opening. The supply pipe is provided above the valve body with an opening (18) which communicates with the accumulating chamber in the closing position and which communicates with the pressure chamber when the valve housing is lifted from the seating.

11 Claims, 5 Drawing Figures

FLUSH SYSTEM

The present invention relates to a flush system which is designed to deliver a given volume of water, delivered from a supply or delivery valve means to the inlet of an accumulating chamber.

The flush arrangement is primarily intended for flushing WC-basins, urinals and like sanitary devices, but can also be used in other contexts. WC-basins are today mainly flushed by means of flushing cisterns or flushing valves. One advantage with flushing cisterns, i.e. water containers, which are refilled relatively slowly after each flush and which deliver the water contained therein quite rapidly when the toilet is flushed, is that the flow rate of the water to the cistern, the ingoing water flow, can be kept relatively low, e.g. 0.1 liters/-second, and therefore does not influence the dimensioning of the water-supply system of a building. Flushing cisterns, however, require a relatively large amount of space, and often represent more than half the cost of a low-flush WC-basin. A further, and serious, disadvantage with known flusing cisterns is that the inlet valve is constantly under the water-pipe pressure and is of the kind comprising a valve seating and a co-acting valve body. Consequently, it is unavoidable that with time the valve will begin to leak, resulting in an annoying dripping sound. Between flushes, the valve body of the bottom valve is under pressure from the accumulated water, and gradually this valve will also begin to leak, resulting in high water costs and a disturbing noise.

In order to avoid these and other drawbacks associated with such flushing cisterns, attempts have been made to use flush valves instead, which take up little room and are cheaper than flushing cisterns. Since the flush is delivered directly to the basin from the water-supply pipe, via flush valves, the pipe must be dimensioned to accommodate the flow rate required to rinse the basin clean, for example a flow rate of 1.5 liters/-second. In order to achieve this rate of flow, it is necessary to install relatively wide pipes and to ensure that the water pressure is not excessively low. Compared with the pipes used in connection with flushing cisterns, the costs incurred when installing wide pipes required for flush valves are very high. Often the use of flush valves is totally excluded, because the pressure of the water is too low, which means that the more expensive flushing cistern must be used, with all its drawbacks. Irrespective of whether one uses a flushing cistern or a flush valve, it is impossible to achieve the most suitable basin flushing sequence, i.e. a sequence in which a large flow of water is delivered initially to the basin, to flush away excreta and paper, followed by a smaller flow of water for replenishing the water seal of the toilet basin, when necessary, said water seal being emptied at times by the sudden down flush of solid substances.

Consequently, a main object of the invention is to provide a flushing system which does influence the dimensioning of the ingoing-water supply system; which is totally leakage-free between flushes; the flushing effect of which is not contingent upon the pressure in the water supply pipes; and which can be placed in an after-flush or secondary-flush mode if so desired.

This object is achieved with a flushing system of the kind mentioned in the introduction, which is mainly characterized in that a float-controlled discharge valve is arranged to be opened when said given volume of water has been delivered to the accumulating chamber and the float is located at a corresponding level in said chamber; in that a supply pipe communicating with said inlet extends downwardly in the accumulating chamber towards said outlet; in that a valve housing co-acting with said float is slidably arranged, together with said float, on said water supply pipe; in that in the closing position of the valve housing, the lower edge part of said valve housing is arranged, in the absence of said given volume of water in the accumulating chamber; to abut or to lie closely adjacent to a seating encircling the outlet; in that in the opening position of the valve housing, when the accumulating chamber has received said given volume of water, the valve housing is arranged to be lifted relative to the seating by said float; in that the lower end of the supply pipe is formed with a valve body arranged, together with the inner wall of the valve housing, to form a pressure chamber having at least one leakage opening; and in that the supply pipe is provided above the valve body with at least one supply opening which communicates with the accumulating chamber in the closing position of the valve housing, the arrangement being such that when the valve housing is lifted together with the float, said supply opening is brought into communication with the pressure chamber, whereupon the water under pressure in the pressure chamber lifts the valve housing relative to the valve body to a highest position, in which water in the accumulating chamber can run freely out through the outlet and hold the valve housing in said highest position, at least until the supply of water to the water supply pipe ceases.

The invention will not be described in more detail with reference to the accompanying drawings, in which FIG. 1 is an axial cross sectional view of a flushing system according to the invention having a supply valve arrangement shown in a filling position;

FIG. 1*a* is an axial system similar to that of FIG. 1 but showing the system in a flushing operation.

Figure 1:
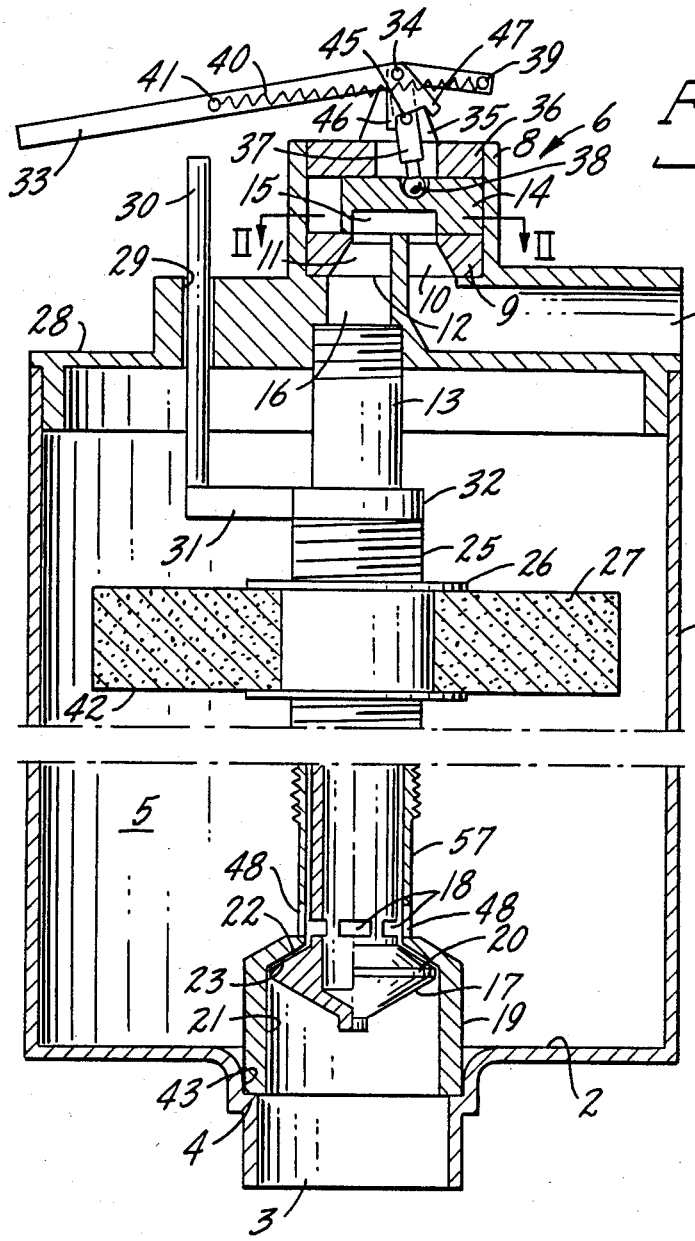
Figure 1A:
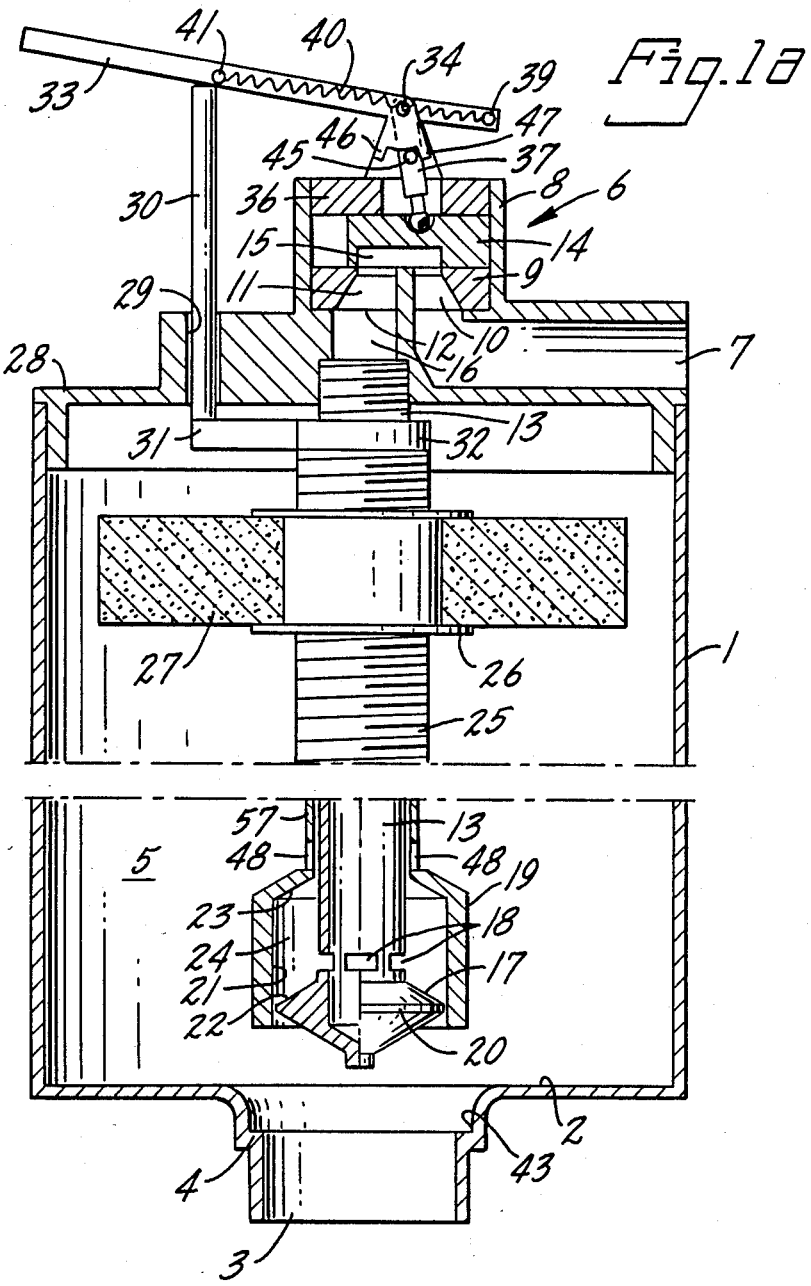

FIGS. 1 and 1*a* illustrates a flushing system which includes a tank 1 of any desired cross-sectional shape, for example of rectangular of circular cross-section. The tank 1 has a bottom 2, which is provided with an outflow opening or outlet 3. The outlet 3, which is assumed to be circular in the illustrated embodiment, is surrounded by a seating 4. The tank 1 forms an accumulating vessel 5, to which water is supplied when a flush is to be made. The supply of water is effected through a valve means 6 which is connected to a pressure-water line or pipe 7. The connecting part of the pressure-water line 7 is located in a valve housing 8, having arranged therein a stationary ceramic plate 9, suitably made of aluminium oxide. The stationary plate has an inlet 10 which is connected to the line 7, and an outlet 11 which is connected to an inlet 12 leading to a water-supply line or pipe 13, which extends down in the accumulating chamber 5, towards the outlet 3. Co-acting with the stationary plate 9 is a movable valve plate 14 which is provided on its under surface with a recess or cavity 15 which, in the position illustrated in FIG. 1, connects the inlet 10 with the outlet 11. Thus, when the pressure water line 7 is connected to a source of water under pressure, the water will flow in through the inlet 10 to the outlet 11, via recesses or cavities 15, and from the outlet 11 into the supply opening 16 of the water supply line 13. The supply line 13 is provided on its lower end with a valve body 17, and above the valve body 17 is located at least one supply opening 18 through which water supplied from the valve means 6 can exit. The valve body 17, which in the FIG. 1 embodiment comprises a member in the form of two cones with the bases of said cones facing each other, is mounted in a valve housing 19. In the illustrated embodiment, the valve body 17 has a peripheral surface 20 which slides against or lies closely adjacent to the interior, cylindrical wall 21 of the valve housing 19, and a upper surface 22 which lies adjacent an upper wall 23 of the valve housing. The surfaces 22 and 23 define therebetween a pressure chamber 24. In the illustrated embodiment, the valve housing 19 is connected to a sleeve 57, or an equivalent guide means, which embraces the cylindrical supply line 13. The sleeve 57 is provided in a part thereof located above the valve housing 17 with an outflow opening 48, which in the closing position of the valve housing shown in FIG. 1, registers with the opening 18.

The sleeve 57 is provided with external screw threads 25, on which is mounted a hub means 26 which carries a float 27. The float 27, which may comprise, for example, a closed-cell foam plastics material, or an annular vessel, is slidably attached to the supply line or pipe 13 via the hub 26, and can be adjusted to any desired position on the sleeve 57, said hub 26 being in screw-mesh engagement with the screw threads 25 on sleeve 57 to this end. The upper, open end of the chamber 5 is covered by a cover 28, which is firmly secured to the tank 1 by means of suitable fasteners, not shown, such as screws for example. The cover 28, which incorporates the aforedescribed supply valve, has an opening or channel 29 whose axis is parallel with the axis of the supply line 13, and in which opening or channel there is slidably arranged an operating rod 30, the lower end of which is connected to a cross-bar 31, which in turn is connected to a slide ring 32 on the supply line. Arranged for co-action with the upper end of the operating rod 30 is a lever 33, which is pivotally mounted on a shaft 34, which in turn has the ends thereof journalled in end walls 35, of which only the rear end wall is shown in FIGS. 1 and 1*a*, said end walls being fixedly mounted on a lid 36. As shown in FIGS. 1 and 1*a*, the lever 33 comprises an angled double-arm lever. One operating arm 37 of the lever 33 has arranged on the free end threreof a ball 38, which is accommodated in a recess in the upper, movable valve plate 14. When the lever 33 is in the position shown in FIG. 1, the valve plate is in an opening position, i.e. water from the supply line 7 flows into the line 13. Arranged between the lever 33 and a fixed point 39 on the valve arrangement is a tension spring 40, which holds the lever 33 in the position shown in FIG. 1, but which, when the lever 33, through the operating rod 30, is subjected to an upwardly acting force, snaps the lever over in an upwards direction, to the position shown in FIG. 1*a*, as soon as a dead-centre position, in which the shaft 34 lies on a straight line extending between the attachment points 41 and 39 of spring 40, is passed. In the lever position shown in FIG. 1*a*, the operating ball 38 begins to be moved to the left in FIG. 1*a*, thereby to move the movable valve plate 14 also to the left, until the inlet 10 is no longer in communication with the cavity 15 and the supply of water from the pressure water line 7 to the line 13 ceases.

As will be seen from FIGS. 1 and 1*a*, the operating lever or arm 33 is journalled on a shaft 34 on which the upper end of the operating arm 37 is also pivotally mounted. Arranged between the two ends of the operating arm 37 is a guide pin 45, which lies between two abutments or shoulders 46,47 on the shorter arm of the lever 33, thereby enabling lever 33 to move to the dead-centre position before the valve plate 14 is activated.

The aforedescribed arrangement has the following mode of operation: A flush shall be made, and the accumulating chamber 5 is consequently empty. In order to deliver water, the water delivery or supply valve arrangement 6 is opened, i.e. the lever 33 is pushed down manually to the position shown in FIG. 1, therewith displacing the movable valve plate 14 to the position shown in FIGS. 1 and 1*a*. The pressure water line is then connected with the line or pipe 7 and water flows into the supply line 13 and exits through the openings 18 and 48 into the accumulating chamber 5. Initially, the float 27 is in the position shown in FIG. 1. As soon as the level of water reaches the bottom 42 of the float 27, the float will move upwards, and through the agency of the illustrated mechanical coupling, active between the float and the valve housing 19, the valve housing 19 and its lower edge, which forms a sealing or at least substantially sealing connection with the seating 4 around the outlet 3, will also be moved upwardly. It should be noted that the aforesaid seating may also consist of the cylindrical wall surface 43, or some other suitable surface on the inside of the tank 1.

Thus, the float 26 lifts the valve housing 19 from the seating 4, but not from the seating 43. This is important in the case of small quantities of ingoing water. When the quantity of ingoing water is small, the seating 43 shall restrict the leakage of water to an extent such that the float retains its buoyancy unitl the supply opening is closed, either partially or fully, and the pressure chamber 24 produces a sufficient lifting force. The valve housing 19 does not leave its seating 43 until the pressure chamber 24 begins to expand and exercises its lifting function. If the passage of water past the seating 43 becomes equal to the amount of water supplied, an unstable state prevails. It should be observed, however, that when large quantities of water are supplied, the function of the system is only dependent upon the seating 4, among other things because the valve housing 19 need not be lifted to its fullest extent, since even a partial connection between the supply opening 18 and the pressure chamber 24 results in the necessary rapid separation of the surfaces 22 and 23, one from the other.

As soon as the valve housing has been lifted, i.e. when a given amount of water has collected in the accumulation chamber 5, to an extent such that the opening 18 is partially blocked by the wall of the housing 19, a given amount of water will flow into the pressure chamber 24 formed between the inner wall 23 of the valve housing and the surface 22 of the valve body. The pressure of the water in the pressure chamber 24 causes the surfaces 22 and 23 to move quickly apart, i.e. the valve housing is lifted rapidly, so that the water in the accumulating chamber can run substantially freely therefrom, via the outlet 3. The pressure of the water in the pressure chamber 24 forces the valve housing 19 to an upper position, shown in FIG. 1*a*, in which all the water delivered from the supply or delivery valve arrangement 6 will flow into the pressure chamber 24, via the opening or openings 18. The pressure chamber 24 has leakage openings, which in the embodiment illustrated in FIGS. 1 and 1*a*, comprise substantially the circular gap between the inner wall 21 of the valve housing 19 and the defining edge of the valve body 17, through which gap the ingoing water can first combine with and amplify the flow of water leaving the accumulating chamber 5, and then constitute the after-flush or secondary-flush water. In the illustrated emboidment, the duration of the after-flush period is determined by the strength of the spring 40. The stronger the spring, the shorter the after-flush time. When the supply of water to the line 13 is interrupted, the pressure in the pressure chamber 24 will consequently fall, and the valve housing 19 slide downwardly, as a result of the leakage of water from the pressure chamber 24. The amount of water leaking from the pressure chamber 24, and continuing to leak-out for a short period of time after the supply of water has been stopped, can be regulated as desired in dependence upon the area of the leakage gap, thereby enabling the desired closing time to be set. As will be understood, the volume of water accumulated can be regulated by changing the axial setting of the float on the sleeve 57. The closing time must be at least long enough to give the accumulating chamber time to empty.

When the valve housing has reached its upper position, the rod 30 has activated the lever 33 and swung it beyond the dead-center point, the position in FIG. 1*a*, and the lever continues the closing movement, under the action of the spring 40, to reach a completely upwardly turned position, not shown. The speed at which the closing movement is effected from the position of the lever arm 33 in FIG. 1*a*, depends upon the force exerted by the spring and the friction between the movable plate 14 and the stationary plate 9. When the lever 33 has reached the position in FIG. 1*a*, the movable plate 14 begins to move to the left in FIGS. 1 and 1*a*, to an extent such that the inlet opening 10 is completely sealed off by the right-hand surface of the plate 14, as seen in FIGS. 1 and 1*a*, thereby interrupting the supply of water to the pressure chamber 24, whereafter the valve housing is emptied and sinks to its closing position.

Figure 2:
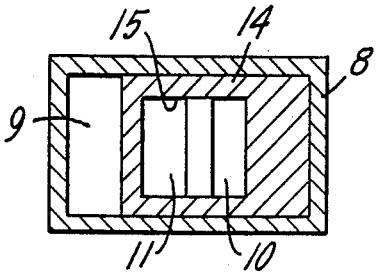
FIG. 2 is a view taken on the line II—II in FIG. 1.
Figure 3:
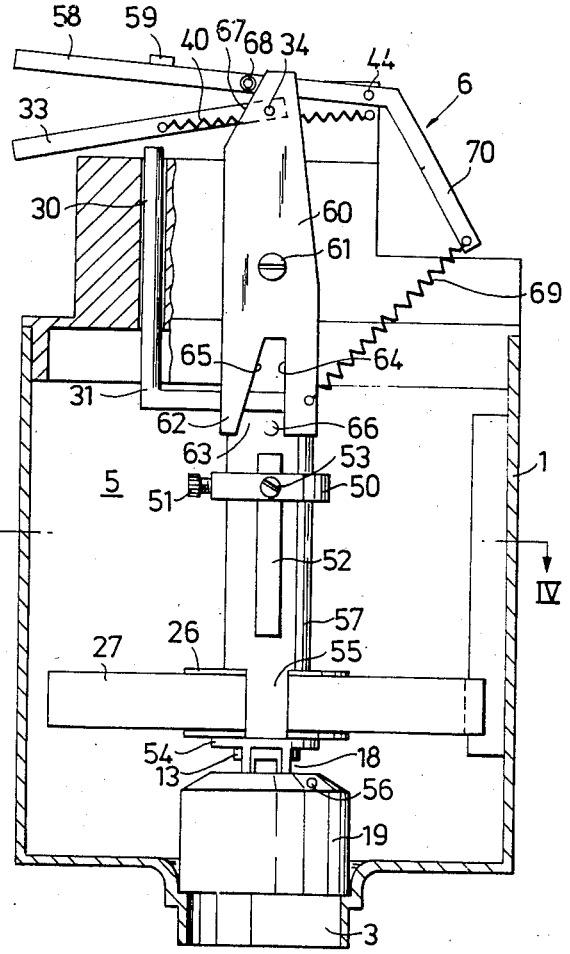
FIG. 3 illustrates a modified flushing system.
Figure 4:
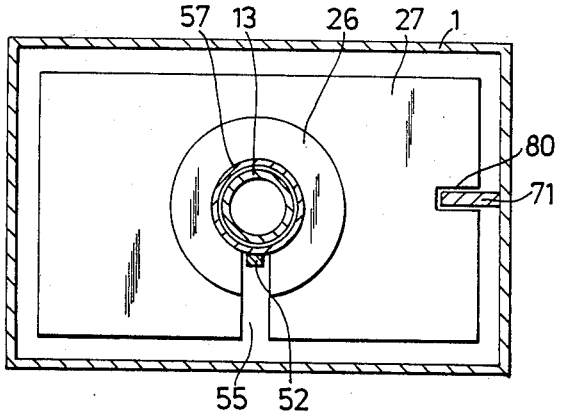
FIG. 4 is sectional view taken on the line IV—IV in FIG. 3.

FIGS. 3 and 4 are simplified illustrations of a further embodiment of the invention which permits two mutually different quantities of water to be delivered. The need for differing amounts of water is particularly evident in countries where water is scarce. In this case, a larger amount of water is used to flush away fecés etc., while a smaller amount of water is used to flush away urine. Those components in the FIGS. 3 and 4 embodiment which correspond to components in the embodiment of FIGS. 1, 1*a* and 2 have been identified with the same reference numerals.

In this embodiment, the float 27 is slidably mounted on the sleeve 57, between two shoulders or abutments, of which one comprises an abutment ring 50 which is axially displaceable on the sleeve 57 and which can be locked to said sleeve by means of a screw 51. The abutment ring 50 carries an abutment rod 52 which extends parallel to the longitudinal axis of the sleeve 57 and which can be displaced relative to the ring 50 and securely locked thereto by means of a screw 53. The second abutment for co-action with the float 57 comprises an annular flange 54 on the lower end of the sleeve 57. As hereinafter described to the lower end of the abutment rod 52 forms a third abutment for co-action with the float 27. The operating lever 33 is used to deliver a large amount of flushing water, such as described with reference to FIGS. 1, 1*a* and 2. In this respect, the abutment rod 52 is located in the position shown in FIG. 3, and will pass freely through a recess 55 in the hub 26 and the float 27. When water flows into the accumulating chamber 5, the float 27 will slide up the sleeve 57 until it finally reaches the abutment ring 50, whereupon the sleeve 57 and the valve housing 19 mounted thereon is lifted slightly, and is raised rapidly to its highest position when water is supplied to the pressure chamber, as described above with reference to FIGS. 1, 1*a* and 2. In the illustrated case, the valve housing 19 is provided with a leakage opening 56 which is connected to the inner pressure chamber. Upon completion of a flushing operation, the lever arm 33 is restored to its upwardly swung position, as described above with reference to FIGS. 1, 1*a* and 2. Mounted on a pivot shaft 44 on the valve housing 6 is a second lever arm or operating lever 58. The lever 58 is provided with a dogging rod 59, which extends in, over the lever 33. A pivotable guide bar 60 is pivotably mounted on a pivot shaft 61, mounted on the housing 6. The guide bar 60, which is punched from sheet metal, has a lower end 62 which lies closely adjacent the sleeve 57. Located in said end 62 is a recess or slot 63, which is defined by a perpendicular edge 64, which extends parallel to the longitudinal axis of the sleeve 57, and an oblique edge 65. The oblique edge, which is here shown to be rectilinear but which can have any suitable shape, is arranged to co-act with a guide peg or guide roller 66 mounted on the sleeve 57.

The upper end of the guide bar 60 is provided with an oblique edge 67, which is arranged to co-act with a camming roller 68 on the lever 58. A spring 69 is stretched between the lever arm 70, lying to the right of the shaft 44, and a location on the part of the guide bar lying beneath the pivot point 61, and holds the oblique camming surface 67 against the roller 68. As will best be seen from FIG. 4, the float 27 has a slot 80, which receives a guide 71 fixedly mounted on the inside of the tank 1, thereby to prevent the float from turning. When a small amount of water is to be flushed out through the outlet 3, the lever 58 is pushed down, and the dogging rod 59 will cause the lever 33 to move to its depressed position. Water will then flow into the supply line, as described with reference to FIGS. 1, 1*a* and 2. As beforementioned, the roller 68 on the lever 58 lies against the camming surface 67, and causes the guide bar 60 to be turned clockwise in FIG. 3 around the shaft 61, so that the abutment surface 64 moves the peg 66 to the left in FIG. 3, i.e. the sleeve 57 is turned clockwise, and the release rod 52 will therefore be moved out of register with the recess 55. When the lever 56 is released, it is returned to the starting position illustrated in FIG. 3, under the action of the spring 69, and the guide bar 60 also returns to the illustrated position. The lever 33 is held depressed, however, until the float 27 is lifted by the water flowing into the accumulating chamber, to an extent that the hub 26 comes into contact with the rod 52, whereupon said initial lifing of the valve housing takes place. The said small amount of flushing water is released as soon as the float 27 has reached the end of the rod 52 and has caused said initial lifting of the valve housing 19. The sleeve 57 is turned back by the peg 66 sliding against the camming surface 65, as the sleeve 67 moves upwards.

The two aforedescribed, specific embodiments of the novel flushing system can be varied with wide limits, without departing from the concept of the invention. The accumulating chamber has been assumed to be of a rectangular shape when seen in a horizontal plane as illustrated in FIG. 4, although it may have any suitable form. Furthermore, it will be understood that although the valve body 17 has been described, and shown in FIGS. 1 and 1*a*, as comprising two cones whose bases face one another, the body may have any suitable form, for example the form of a cylinder piston. The illustrated water supply valve, which forms no part of the invention, has only been selected by way of example and can be replaced, for example, with a time-controlled flush valve, or any manually operated valve for supplying water to the accumulating chamber. The described sleeve 57, which is described as being tubular, has the single purpose of either mechanically connecting the valve housing to the float, or to form a holder for the abutments which co-act with the float. Consequently, the sleeve can be replaced with an open-mesh cylinder, whereupon the openings 48 are obtained automatically, or with a plurality of vertically extending steel wires joined to the valve housing 19.

I claim:

1. A flushing system which is designed to deliver a given volume of water which is supplied from a water-supply valve (6) to an inlet (7) of an accumulation chamber (5), characterized in that a discharge valve (19) controlled by a float (27) is arranged to be opened when said given volume of water has been delivered to the accumulating chamber and the float (27) is located at a corresponding level in said chamber (5); in that a supply pipe (13) communicating with said inlet extends downwardly in the accumulating chamber (5) towards said outlet (3); in that a valve housing (19) co-acting with said float (27) is slidably arranged, together with said float, on said water supply pipe (13); in that in the closing position of the valve housing, the lower edge part of said valve housing is arranged, in the absence of said given volume of water in the accumulating chamber, to abut or to lie closely adjacent to a seat (4, 43) encircling the outlet (3), in that in the open position of the valve housing, when the accumulating chamber (5) has received said given volume of water, the valve housing is arranged to be lifted relative to the seating by said float (27); in that the lower end of the supply pipe is formed with a valve body (17), arranged together with the inner wall (23) of the valve housing, to form a pressure chamber (24) having at least one leakage opening; and in that the supply pipe is provided above the valve body with at least one supply opening (18) which communicates with the accumulating chamber (5) in the closing position of the valve housing (19), the arrangement being such that when the valve housing (19) is lifted together with the float (27), said supply opening (18) is brought into communication with the pressure chamber (24), whereupon the water under pressure in the pressure chamber lifts the valve housing (19) relative to the valve body (17) to a highest position, in which water in the accumulating chamber (5) can run freely out through the outlet and hold the valve housing (19) in said highest position, at least until the supply of water to the water supply pipe (13) ceases.

2. A flushing system according to claim 1, characterized in that the float (27) and the valve housing (19) are arranged on a common holder (57) which is slidably mounted on the supply line (13).

3. A flushing system according to claim 1, characterized in that the valve housing (19) is fixedly connected to one end of a holder (57) which is slidably arranged on the supply line (13); and in that the float is slidable on the holder (57), which is provided at a distance from the valve housing with stop (50) arranged to limit movement of the float along said holder (57).

4. A flushing system according to claim 3, characterized in that the stop (50) is adjustable in the axial direction of the holder (57).

5. A flushing system according to claim 3, characterized by guide means (60) for rotating the holder (57) around the supply line to either one of two positions of rotation, each position having located thereat an axial abutment (50,52) for co-action with the float.

6. A system according to claim 1, characterized in that the holder (57) has the form of a sleeve which is slidably arranged on the supply line (13) and which is provided with one or more openings (48) which are arranged to register with the supply opening or openings (18) in the closing position.

7. A flushing system according to claim 4, characterized by guide means (60) for rotating the holder (57) around the supply line to either one of two positions of rotation, each position having located thereat an axial abutment (50, 52) for co-action with the float.

8. A system according to claim 2, characterized in that the holder (57) has the form of a sleeve which is slidably arranged on the supply line (13) and which is provided with one or more openings (48) which are arranged to register with the supply opening or openings (18) in the closing position.

9. A system according to claim 3, characterized in that the holder (57) has the form of a sleeve which is slidably arranged on the supply line (13) and which is provided with one or more openings (48) which are arranged to register with the supply openings or openings (18) in the closing position.

10. A system according to claim 4, characterized in that the holder (57) has the form of a sleeve which is slidably arranged on the supply line (13) and which is provided with one or more openings (48) which are arranged to register with the supply opening or openings (18) in the closing position.

11. A system according to claim 5, characterized in that the holder (57) has the form of a sleeve which is slidably arranged on the supply line (13) and which is provided with one or more openings (48) which are arranged to register with the supply opening or openings (18) in the closing position.

* * * * *